United States Patent [19]

Pless

[11] 3,998,175

[45] Dec. 21, 1976

[54] MULTI-HULL VESSELS

[76] Inventor: John H. Pless, 48 Kinnerton St., London, S.W.1, England

[22] Filed: Nov. 27, 1972

[21] Appl. No.: 309,791

[30] Foreign Application Priority Data

Nov. 29, 1971 United Kingdom ..... 55205/71

[52] U.S. Cl. ..... 114/39; 114/61

[51] Int. Cl.[2] ..... B63H 9/04

[58] Field of Search ..... 114/39, 61, 102

[56] References Cited

UNITED STATES PATENTS

| | | | |
|---|---|---|---|
| 606,104 | 6/1898 | Twining | 114/102 |
| 2,106,432 | 1/1938 | McIntyre | 114/102 |
| 3,223,064 | 12/1965 | White | 114/39 |

FOREIGN PATENTS OR APPLICATIONS

| | | | |
|---|---|---|---|
| 1,404,012 | 7/1964 | France | 114/39 |

OTHER PUBLICATIONS

American Catamarans, published by the Amateur Yacht Research Society, 1957, publication No. 10, p. 16.

*Primary Examiner*—Trygve M. Blix
*Assistant Examiner*—Stuart M. Goldstein
*Attorney, Agent, or Firm*—Carroll F. Palmer

[57] ABSTRACT

A multi-hull vessel includes at least a pair of substantially parallel interconnected hulls and the outermost hulls each include a mast for supporting a sail. When sailing close hauled the wind on the leeward sail produces a force having a component tending to lift the adjacent windward hull out of the water which is counterbalanced by a corresponding downward component of the force produced by the wind on the windward sail.

1 Claim, 2 Drawing Figures

MULTI-HULL VESSELS

This invention relates to multi-hull vessels such as the catamaran and the trimaran.

One disadvantage of the catamaran, which limits the amount of sail that can be carried, is the vulnerability to capsizing. Once capsized a catamaran cannot easily be righted.

In accordance with the present invention a multi-hull vessel includes at least a pair of substantially parallel interconnected hulls, the outermost hulls each including a mast for supporting a sail, whereby, when sailing close hauled, the wind on the leeward sail produces a force having a component tending to lift the adjacent windward hull out of the water which is counterbalanced by a corresponding downward component of the force produced by the wind on the windward sail. As a result, the vessel is held in equilibrium and there is no tendency to capsize in strong winds. One of the masts is preferably stepped back relative to the other mast to prevent blanketing of the leeward sail by the windward sail.

In a trimaran embodying the invention, the masts are mounted on the two wing hulls and the boat is controlled from the main central hull. The weight of the central hull improves the stability of the vessel, and the central hull will normally include a centreboard plate. The centre line of the central hull will normally lie the same fixed distance from each of the centre lines of the two wing hulls, and this distance is preferably equal to the distance between the base of either mast and the centre of pressure on the sail carried by the respective mast.

One example of the invention will now be described with reference to the accompanying drawings in which.

The trimaran consists essentially of two wing hulls 1 and 2 on a centre hull 3. The two wing hulls are narrower and have less buoyancy than the main central hull which includes the cockpit 4.

Figure 1:
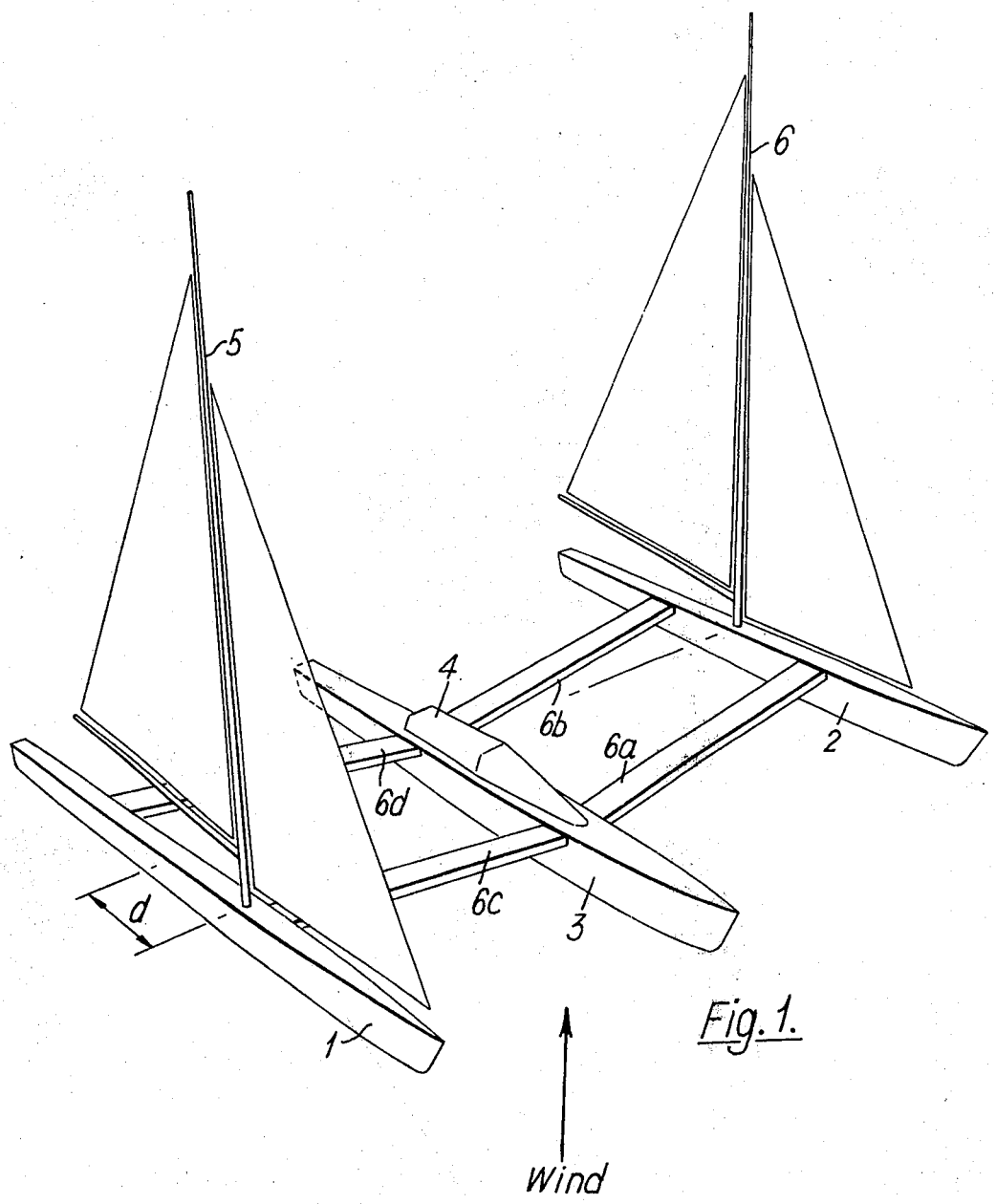
FIG. 1 is a perspective view of a trimaran embodying the invention.
Figure 2:
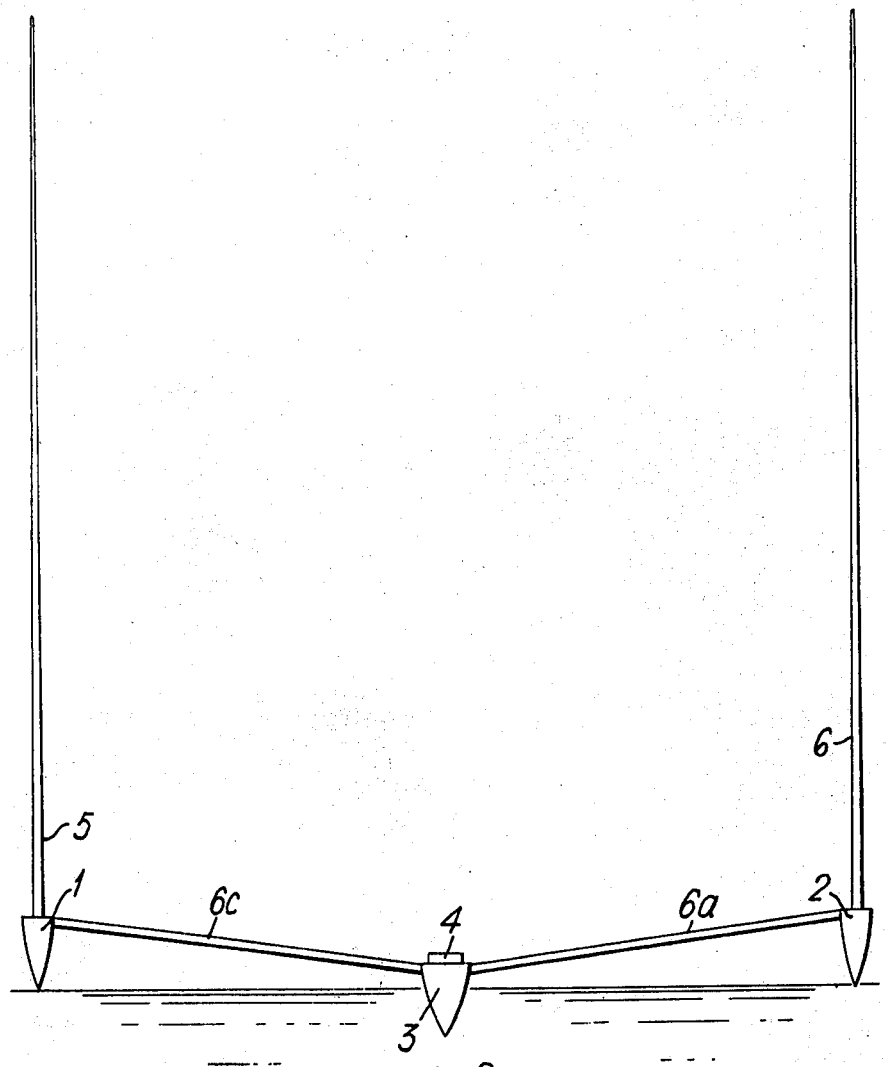
FIG. 2 is a front elevation view, partly in perspective, of the trimaran illustrated in FIG. 1.

The mast 6 on the hull 2 is stepped back relative to the mast 5 on the hull 1 by an amount *d*. The four struts 6 which connect the wing hulls to the main hull are inclined upwards to the horizontal so that the hulls 1 and 2 just rest on the surface of the water when the trimaran is afloat with its two masts vertical. Thus if, for example, the trimaran is on the starboard tack (as shown in FIG. 1), the struts 6*a*, 6*b* will be urged upwards whereas the struts 6*c*, 6*d* will be urged downwards and, assuming the two forces to be substantially equal, the net force on the central hull 3 will be zero so that the trimarin is maintained on an even keel. If the forces are not exactly equal than one of the wing hulls will be slightly submerged. To counteract this the two wing hulls may also include hydrofoils which, when the main hull is horizontal, lie just above the surface of the water. If, for example, the force applied to struts 6*a*, 6*b* is greater than that applied to struts 6*c*, 6*d*, then as the hull 2 sinks downwards its associated hydrofoil begins to penetrate the surface of the water and the hull is urged upwards to counteract the slightly higher force on the struts 6*a*, 6*b*.

The sails may comprise rigid (or semi-rigid) wing sails (aerofoils), or conventional sails. When rigid sails are used the trimaran can be kept level by means of ailerons controlled from the cockpit in the main hull. The aerofoil wing sails may be symmetrical with a fixed camber, or may be asymmetrical with an adjustable camber. The wing sail may be either controlled by sheets in the ordinary way or by an adjustable vane.

I claim:

1. A fore-and-aft rigged trimaran including a central hull and two wing hulls, each of said wing hulls having stepped thereon a vertical mast carrying a boom for extending the foot of a sail hoisted on said mast, one of said masts being stepped back along its hull relative to the other mast, a pair of supporting struts connecting one of said wing hulls to the central hull, a second pair of supporting struts connecting the second of said wing hulls to the central hull, each pair of struts being inclined upwards from said central hull to the horizontal when said trimaran is afloat with its two masts vertical.

* * * * *